US012207732B2

(12) United States Patent
Montgomery

(10) Patent No.: US 12,207,732 B2
(45) Date of Patent: Jan. 28, 2025

(54) EXERCISE APPARATUS

(71) Applicant: Zenith Pivotal Ltd, Waltham Abbey (GB)

(72) Inventor: Colin Montgomery, Waltham Abbey (GB)

(73) Assignee: Zenith Pivotal Ltd, Waltham Abbey (GB)

( * ) Notice: Subject to any disclaimer, the term of this patent is extended or adjusted under 35 U.S.C. 154(b) by 142 days.

(21) Appl. No.: 17/976,204

(22) Filed: Oct. 28, 2022

(65) Prior Publication Data

US 2023/0057347 A1 Feb. 23, 2023

Related U.S. Application Data

(63) Continuation of application No. PCT/IB2021/053410, filed on Apr. 26, 2021.

(30) Foreign Application Priority Data

Apr. 28, 2020 (GB) ..... 2006263

(51) Int. Cl.

| | |
|---|---|
| ***A47C 17/86*** | (2006.01) |
| ***A63B 1/00*** | (2006.01) |
| ***A63B 23/12*** | (2006.01) |

(52) U.S. Cl.

CPC ..... *A47C 17/86* (2013.01); *A63B 1/00* (2013.01); *A63B 23/1218* (2013.01); *A63B 2210/04* (2013.01); *A63B 2210/50* (2013.01); *A63B 2225/093* (2013.01)

(58) Field of Classification Search

CPC ..... A47C 17/86; A63B 1/00; A63B 23/1218; A63B 2210/04; A63B 2210/50; A63B 2225/093

See application file for complete search history.

(56) References Cited

U.S. PATENT DOCUMENTS

| | | | | |
|---|---|---|---|---|
| 4,829,610 | A | 5/1989 | Gonzalez-Alvarez et al. | |
| 2012/0060279 | A1 | 3/2012 | Colombo | |
| 2016/0074698 | A1 | 3/2016 | Figueroa | |
| 2016/0199691 | A1* | 7/2016 | Hockridge | A63B 23/0355 482/96 |
| 2020/0101342 | A1 | 4/2020 | Lawton | |
| 2020/0139181 | A1* | 5/2020 | Thomas | A63B 1/00 |
| 2020/0384337 | A1* | 12/2020 | Brasch | A63B 23/1218 |

FOREIGN PATENT DOCUMENTS

| | | | | |
|---|---|---|---|---|
| CN | 1141153 | A | 1/1997 | |
| DE | 3719529 | A * | 12/1987 | A47C 17/38 |
| FR | 2765787 | A1 | 1/1999 | |
| GB | 2289632 | A | 11/1995 | |
| TW | 200522990 | A * | 7/2005 | A63B 1/00 |
| WO | 2018154157 | A1 | 8/2018 | |

* cited by examiner

*Primary Examiner* — Sundhara M Ganesan
*Assistant Examiner* — Jacqueline N L Loberiza
(74) *Attorney, Agent, or Firm* — Van Hoven PC; Stefan D. Osterbur; Joshua Van Hoven

(57) ABSTRACT

Embodiments of the disclosure provide an exercise apparatus that may be converted from a horizontally oriented bed to a vertically oriented exercise station with various attachments. The exercise apparatus includes locking means to secure it in either the vertical orientation or the horizontal orientation. Further, attachments include a rack attachment with telescopic legs.

20 Claims, 11 Drawing Sheets

EXERCISE APPARATUS

CROSS-REFERENCE TO RELATED PATENT APPLICATIONS

This patent application is a continuation of International Application No. PCT/IB2021/053410, filed on Apr. 26, 2021, which claims the benefit of priority to United Kingdom Patent Application No. 2006263.4, filed Apr. 28, 2020, the entire teachings and disclosures of both applications are incorporated herein by reference thereto.

FIELD

This invention relates generally to exercise apparatus in the form of a fabricated frame that is configured to convert from a first, upright, configuration to a second, horizontal configuration.

BACKGROUND

The home gym equipment market has increased exponentially in recent years' thanks partly due to the popularity and influence of so-called social media celebrities promoting workout videos on platforms such as YouTube and Instagram. The closure of gyms and fitness studios during the 2020 COVID-19 pandemic pushed many gym goers towards exercising from home.

Given that many individuals invested heavily in home gym equipment, it is likely that many of those individuals will not continue their gym memberships in favour of continuing to exercise from home.

Social media promoted exercise routines tend to rely on bodyweight exercises, or callisthenics, and home versions of traditional gym equipment such as pull up and dip bars and weights. Exercising at home has many advantages over going to the gym and exercising outside. For example, gym memberships can be expensive, and it can be difficult to find time to visit the gym often enough to justify the expense. Often, the nearest gym can be too far away from home to make it viable to frequent on a regular basis. Even where a selected gym is near a person's place of work, it can be difficult to get away from the office for a sufficient period to participate in a workout.

Exercising outside has many health benefits but is typically limited to cardiovascular exercise such as running, cycling and other sports. General fitness activities are more difficult to achieve outside in the absence of a "functional" playground, for example. Furthermore, exercising outside can be negatively affected by the weather.

On the other hand, exercising at home can be more easily slotted into a person's everyday activities. There is no need to travel to the gym and the only cost is the initial investment in suitable exercise equipment. It is not however practical for person's residing in small accommodation units, i.e., flats and studio apartments, to store or use exercise equipment in their home. Furthermore, many individuals live in shared accommodation and the only space they may have available to them for general living is a single bedroom with limited floor space.

One object of the invention is to provide exercise apparatus that can be used at home when space is at a premium.

BRIEF SUMMARY

One aspect of the invention provides exercise apparatus comprising: a frame having a load bearing portion and a plurality of support legs extending perpendicularly therefrom; a base having a stand for at least partially supporting the frame; and at least one attachment configured to rotate from a first position in which the one or more attachments is stowed and positioned within the frame and a second position in which the one or more attachments extends away from the frame. wherein, the frame is configured in a pivotable relationship with the base such that the frame is permitted to pivot relative to the base from a first, upright configuration to a second, horizontal configuration, wherein the frame is selectively restrained in the first, upright configuration by a locking mechanism engaging the base, the locking mechanism comprising an actuator and at least one retaining pin biased in a locked position to restrain pivoting of the frame relative to the base when in the first, upright configuration, and wherein the locking mechanism is configured to be released by operation of the actuator.

The limited floor space available in many types of accommodation can preclude effective exercise at home. The present invention helps alleviate this problem by combining a bed with an exercise station. When the exercise apparatus is in the first, upright, configuration it is usable as an exercise station to facilitate callisthenics and weighted exercise. When the exercise apparatus is in the second, horizontal, configuration it is usable as a standard bed. This dual purpose makes full use of available floor space to facilitate exercise at home without the need for a dedicated room/area for fitness. The locking mechanism ensures that there is a robust engagement between the frame and the base so that a person's weight suspended from the exercise apparatus can be supported. As such, the present invention promotes callisthenics at home.

The stand may comprise at least one aperture for receiving the at least one retaining pin when the frame is in the first, upright configuration relative to the base and the retaining pin is configured to move from an engaged position whereby the at least one retaining pin moves upwardly into a disengaged position when the actuator is operated and returned downwardly to re-engage with a respective aperture when the actuator is released.

The actuator may comprise a handle and an actuation member extending therefrom terminating at the at least one locking pin. The at least one locking pin may comprise two locking pins and the at least one aperture may comprise two apertures. The wire member may extend from the handle to each of the locking pins and operation of the actuator may be configured to disengage each locking pin from a respective aperture. A sleeve may extend away from each aperture in the base and may be configured to receive a respective locking pin. Each locking pin may be biased in the engaged position by a respective spring and operation of the actuator temporarily overcomes the biasing force imparted on each locking pin by the respective spring.

Each locking pin may comprise an indexing plunger that is configured to engage a striker plate when the frame is in the first, upright configuration.

Each locking pin may be biased in the engaged position by a respective spring and operation of the actuator temporarily overcomes the biasing force imparted on each locking pin by the respective spring.

The one or more attachments may comprise a pull up bar attached to the frame and configured to rotate from a first position in which the pull up bar is stowed and positioned within the frame and a second position in which the pull up bar extends away from the frame.

Provision of a pull up bar facilitates many different callisthenics-based exercises. For example, a user could perform pull ups using the pull up bar or attach one or more items to the pull up bar, i.e., suspension apparatus or resistance bands. The pull up bar is stowed when the exercise apparatus is returned to its horizontal position and deployed when the exercise apparatus is moved into its upright position.

The one or more attachments may comprise a pair of dip bars attached to the frame and configured to rotate from a first position in which each of the pair of dip bars is stowed and positioned within the frame and a second position in which each of the pair of dip bars extends substantially perpendicularly from the frame.

The one or more attachments may comprise a rack having first and second legs each configured to rotate from a first position in which each of the first and second legs is stowed and positioned within the frame and a second position in which each of the legs extends substantially perpendicularly from the frame.

Each leg of the rack may be extendible such that when the leg is in the first position, the leg has a first length and when in the second configuration, the leg has a second length longer than the first length. Each leg of the rack may comprise telescopic extension means.

Each leg may comprise an outer portion and an inner portion, and an actuator configured to move the inner portion from a first position in which it is substantially retracted into the outer portion to a second position in which it is substantially extended from the outer portion.

The actuator may comprise a handle that is mounted to an inner wall of the outer portion of the leg and extends through a cut-out in an opposing wall of the outer portion of the leg.

Operation of the actuator into the second position may urge a ground engaging member of the inner portion of the leg into contact with a floor surface. The ground engaging member may be a foot, a wheel, or a caster, for example.

Each of the pull up bar, dip bars and rack may be locked in either the first position or second position by a locking mechanism. The locking mechanism may comprise a pin configured to engage both the pull up bar, dip bars or rack and a part of the frame.

Another aspect of the invention provides a bed comprising: a frame having a load bearing portion having an upper side for supporting a mattress and an underside, and a plurality of support legs extending perpendicularly therefrom; a base having a stand for at least partially supporting the frame; one or more attachments attached to the underside of the frame configured to rotate from a first position in which the one or more attachments is stowed and positioned within the frame and a second position in which the one or more attachments extends away from the frame; wherein, the frame is configured in a pivotable relationship with the base such that the frame is permitted to pivot relative to the base from a first, upright configuration to a second, horizontal configuration, wherein the frame is selectively restrained in the first, upright configuration by a locking mechanism engaging the base, the locking mechanism comprising an actuator and at least one retaining pin biased in a locked position to restrain pivoting of the frame relative to the base, and wherein the locking mechanism is configured to be released by operation of the actuator.

These and other aspects of the present invention are more readily understood when considered in conjunction with the accompanying drawings and the following detailed description.

BRIEF DESCRIPTION OF THE DRAWINGS

Aspects of the invention will now be described by way of reference to the following figures.

DETAILED DESCRIPTION

The following description is given by of example and is not intended to limit the scope or applicability of embodiments of the invention.

Figure 1:
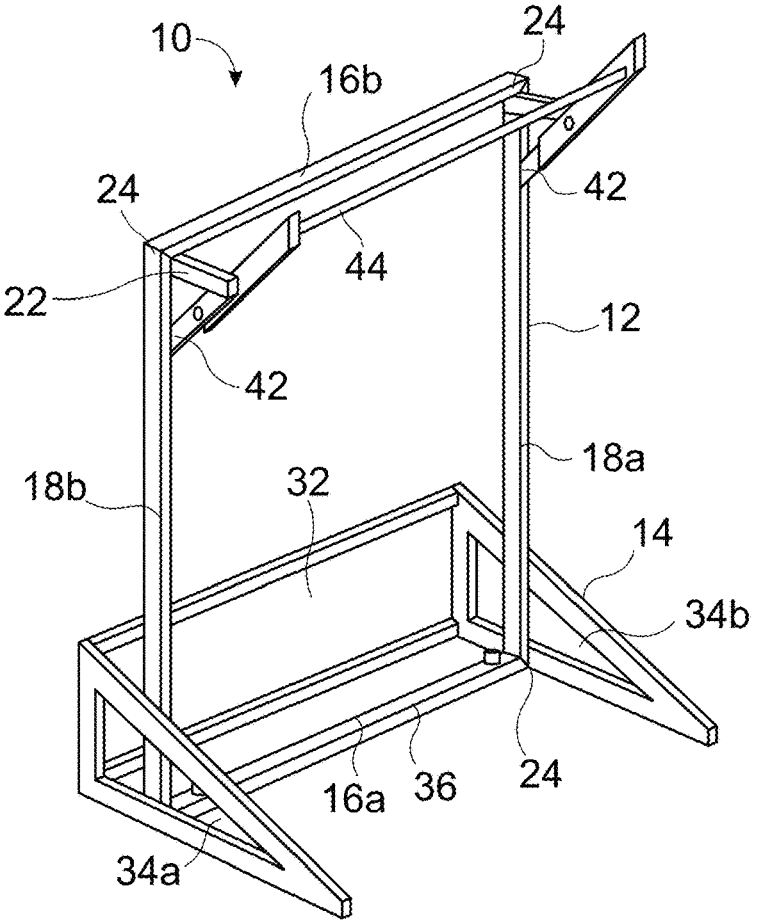
FIG. 1 shows a first perspective view of exercise apparatus according to the present invention.
Figure 2:
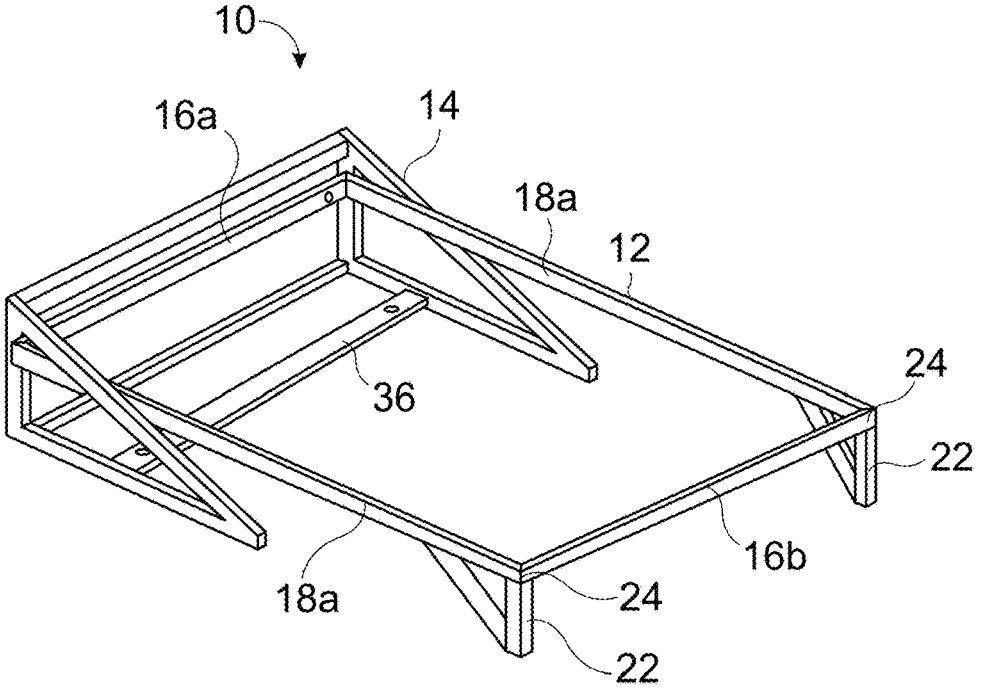
FIG. 2 shows a second perspective view of the exercise apparatus.

As shown in the figures, an aspect of the invention provides an item of exercise apparatus (10) that is configured to convert from a first, upright, configuration, as shown in FIG. 1, to a second, horizontal, configuration, as shown in FIG. 2. The exercise apparatus comprises a frame (12) and a base (14). The frame (12) is pivotable about the base (14) between the first, upright, configuration and second, horizontal configuration. When in the first, upright, configuration, the exercise apparatus (10) is suitable for performing callisthenics-based exercises and, in some embodiments, weight bearing exercises. When in the second, horizontal, configuration, the exercise apparatus (10) is suitable for use as a bed and to support a person lying on a mattress supported by the frame (12).

The frame (12) is of generally rectangular construction and comprises two ends (16*a*, 16*b*) and two sides (18*a*, 18*b*) to define a continuous perimeter. The frame (12) has a head end (16*a*) and a foot end (16*b*). The sides are further connected by way of a plurality of slats or braces (20) not shown in FIG. 1 or 2 for clarity). The slats, or braces, (20) support a mattress and a person lying or sleeping on the mattress when the frame (12) is in the second, horizontal, configuration.

Figure 4:
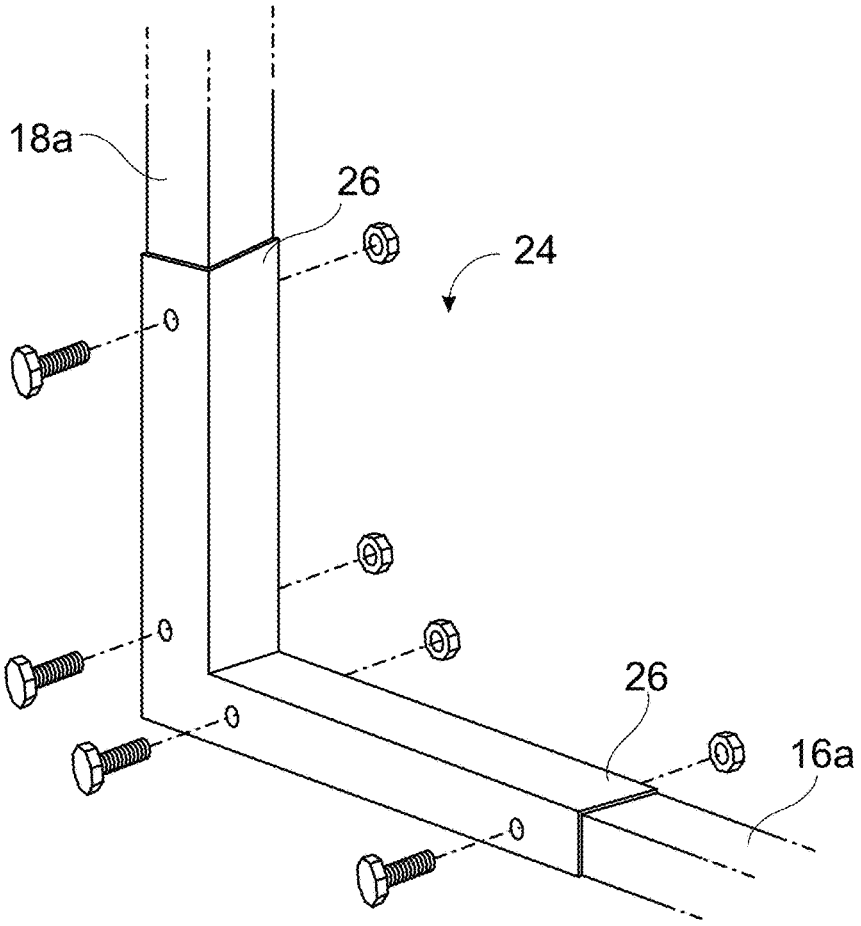
FIG. 4 shows a view of a mounting interface between components of the frame of the present invention.

The ends (16*a*, 16*b*) and sides (18*a*, 18*b*) are orientated at ninety degrees from one another and are connected by way of respective brackets (24) provided at each corner of the frame (12). As shown in FIG. 4, the brackets (24) each comprise a pair of sockets (26) orientated at ninety degrees to one another and a diagonal brace (28) therebetween. Each bracket (24) receives an end (16*a*, 16*b*) and a side (18*a*, 18*b*) in respective sockets (26). The end (16*a*, 16*b*) and side (18*a*, 18*b*) are each bolted to the socket (26) within which they were received to maintain the position of the end (16*a*, 16*b*) and side (18*a*, 18*b*) relative to one another. In some embodiments, a diagonal cross brace connects each of the sockets (26) to provide increased strength.

A plurality of legs (22), at least one at each corner of the foot end (16*b*) of the frame (12), extend perpendicularly from respective corners of the frame (12) to provide a stable, and level, platform on which the frame (12) may be supported when the frame (12) is in the second, horizontal, configuration. The foot end (16*b*) of the frame is connected to the base (14) by way of a pivot connection (28), as further shown in FIG. 3. Each side (18*a*, 18*b*) is pre-drilled at a location proximate to the head end (16*a*) of the frame (12). A pin (30), which may be a steel shoulder bolt, is inserted through each of the pre-drilled holes in the sides (18*a*, 18*b*) of the frame (12) and into pre-drilled holes in the base (14) as described further below.

The base (14) comprises an end (32) and two sides (34*a*, 34*b*) arranged to extend perpendicularly from the end (32) of the base (14). The two sides (34*a*, 34*b*) are connected by way of a lateral restraint (36) to maintain a parallel relationship between the two sides (34*a*, 34*b*) of the base (14). Together, the end (32) and sides (34*a*, 34*b*) of the base (14) define a stand (14) for supporting the frame (12). The base (14) is configured to sit on a level surface.

Figure 3:
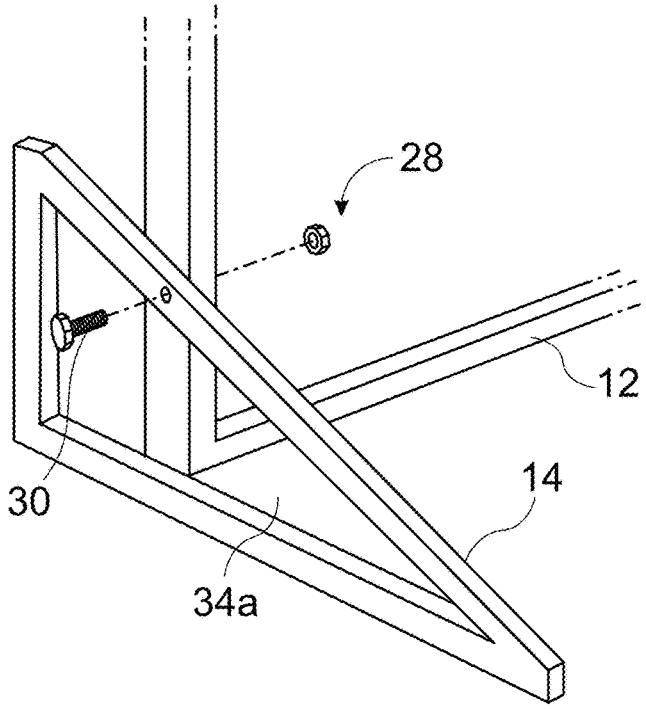
FIG. 3 shows a view of a pivot between the frame and base components of the invention.

As shown in FIG. 3, each side (34*a*, 34*b*) of the base (14) receives the pin (30) therein through the pre-drilled hole in that side (34*a*, 34*b*). This provides the pivotal connection between the frame (12) and the base (14). In some embodiments, bushings may be inserted into each of the predrilled holes in the sides (18*a*, 18*b*) of the frame (12) and sides (34*a*, 34*b*) of the base (14). The bushings may be metal flange bushings impregnated with PTFE to provide a low-friction surface.

In some embodiments, nylon washers may be arranged between the sides (18*a*, 18*b*) of the frame (12) and sides (34*a*, 34*b*) of the base (14).

In some embodiments, gas struts (not shown) further connect the sides (18*a*, 18*b*) of the frame (12) to the sides (34*a*, 34*b*) of the base. A gas strut is connected to each side (18*a*, 18*b*) of the frame (12) at a location further away from the head end (16*a*) of the frame (12) than the predrilled holes through which the pin (30) is inserted. The gas struts are connected to respective sides (34*a*, 34*b*) of the base (14) at a location further away from the end (32) thereof than the pre-drilled holes in the sides (34*a*, 34*b*) through which the pin (30) is inserted. The gas struts are configured to assist a user in moving the exercise apparatus (10) between the first, upright, configuration and the second, horizontal, configuration.

Figure 5:
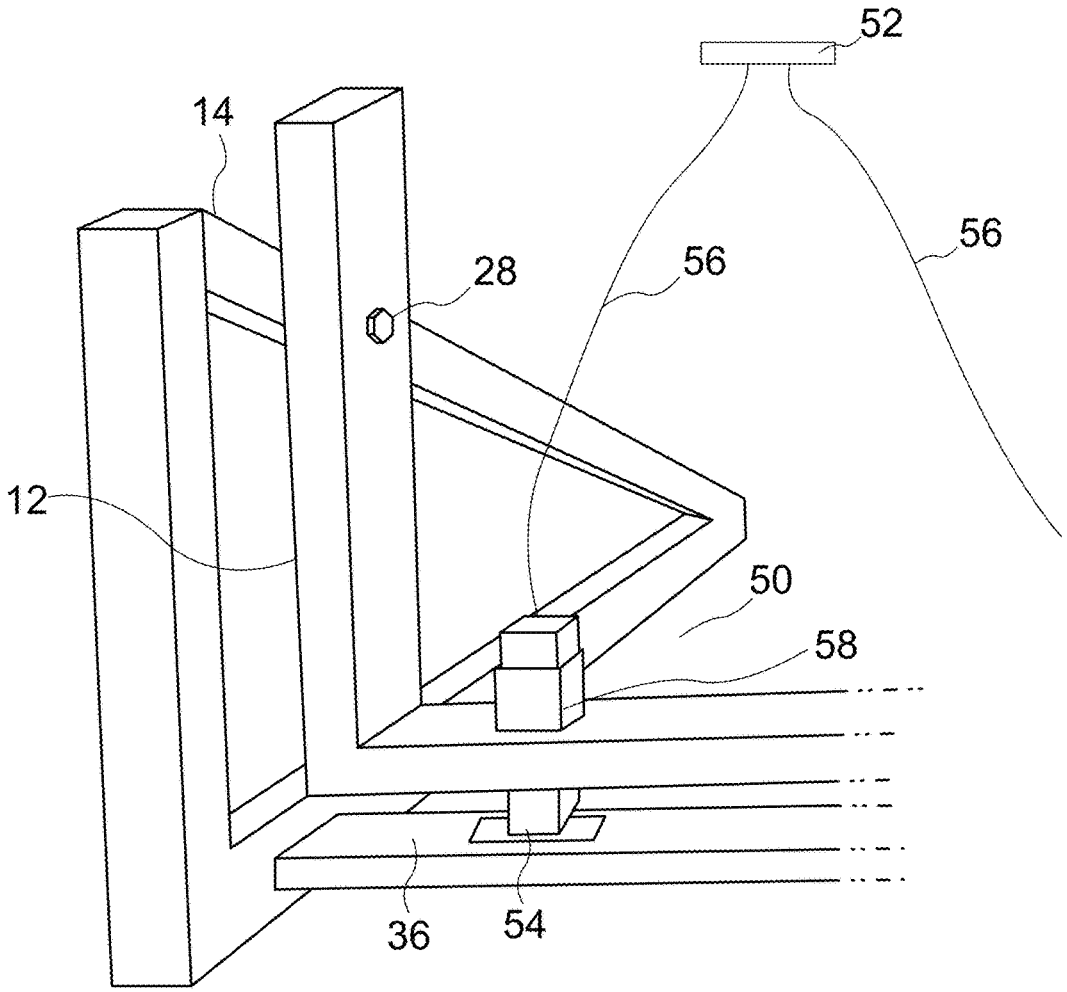
FIG. 5 shows a view of a locking mechanism used in the present invention.
Figure 6:
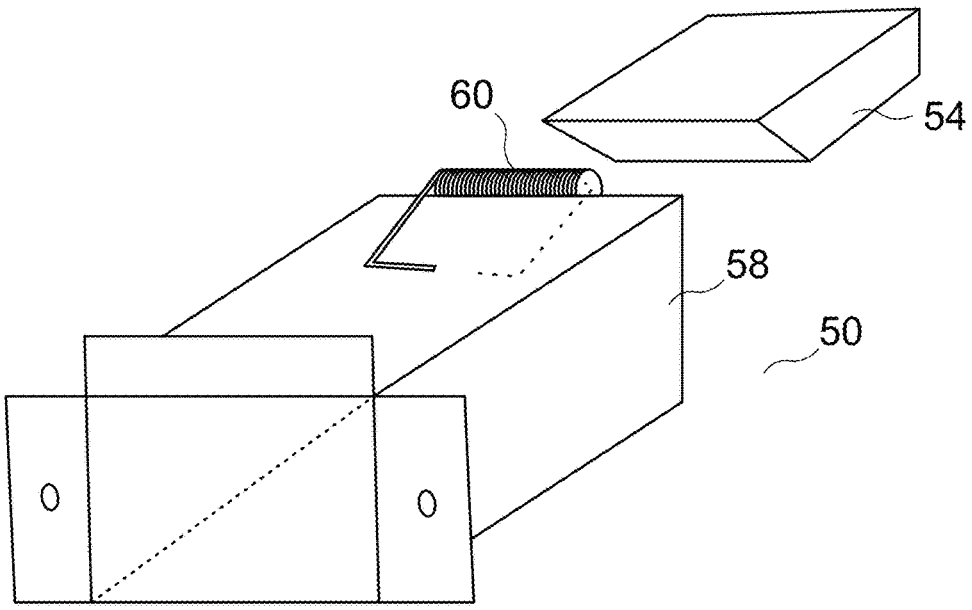
FIG. 6 shows a detailed view of components of the locking mechanism of FIG. 5.

The frame (12) may be lockable in the first, upright configuration by way of a first embodiment of locking mechanism (50), as shown in detail in FIGS. 5 and 6. The locking mechanism (50) comprises an actuator (52) positioned at the foot end (16*b*) of the frame (12) and a pair of locking pins (54) positioned at the head end (16*a*) of the frame (12). As shown in FIG. 6, each locking pin (54) is operatively connected to the actuator by way of a wire (56). The locking pins (54) are restrained within respective sleeves (58) attached to the head end (16*a*) of the frame and aligned with an aperture through the head end (16*a*) of the frame (12). A biasing spring (60) urges each of the locking pins (54) in a downwards direction to cause the locking pins (54) to pass through the apertures in the head end (16*a*) of the frame (12) and to engage corresponding apertures through the lateral restraint (36) of the base (14). The actuator (52) is in the form of a handle which, when pulled, causes the wire to pull the locking pins (54) in an upwards direction to apply a compressive force against the biasing springs (60). As the locking pins (54) move upwards relative to the base (14), the biasing springs (60) compress and the locking pins (54) can move out of engagement with the apertures in the lateral restraint (36) of the base. When the actuator (52) is released, the biasing springs (60) cause the locking pins (54) to pass back through the aperture in the head end (16*a*) of the frame and the apertures through the lateral restraint (36) of the base (14), when the frame is in the first, upright configuration.

Figure 7:
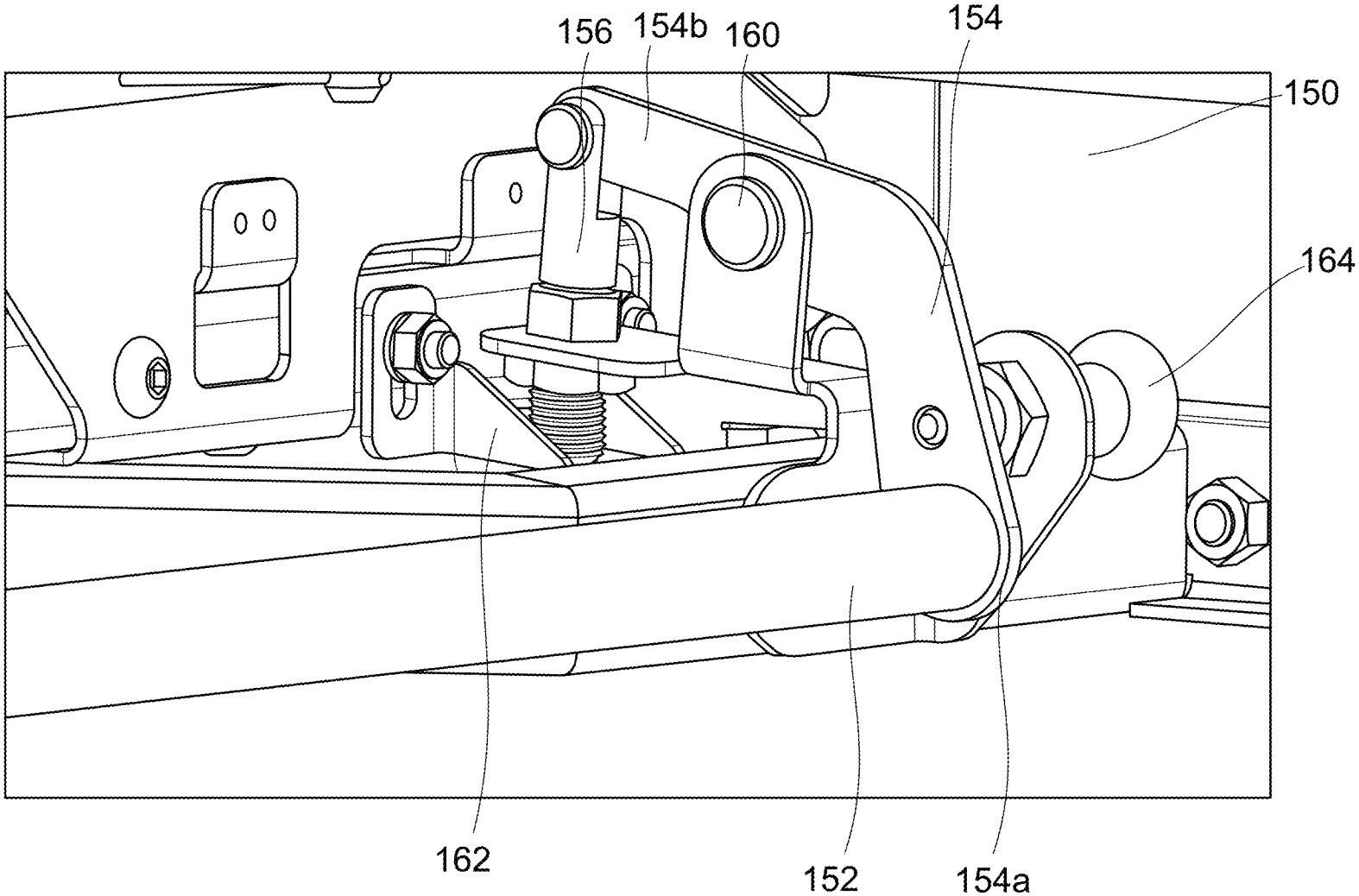
FIG. 7 shows a view of a second embodiment of locking mechanism used in the present invention.
Figure 8:
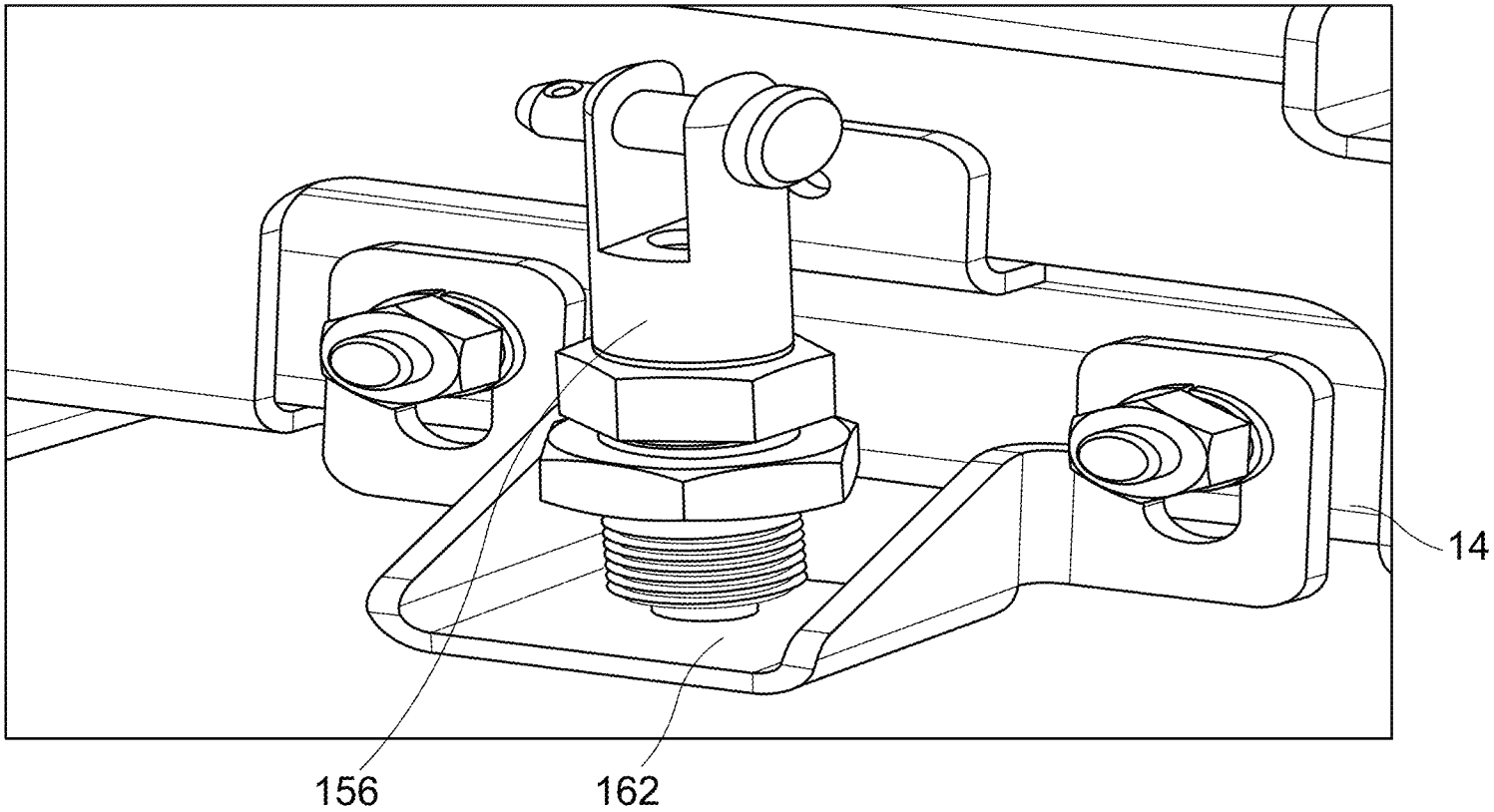
FIG. 8 shows a detailed view of components of the locking mechanism of FIG. 7.

The frame (12) may also be lockable in the first, upright configuration by way of a second embodiment of locking mechanism (150), as shown in detail in FIGS. 7 and 8. The locking mechanism (150) comprises an actuator (152) that is attached to the base (14). The actuator (152) may be a horizontal bar (as shown in FIG. 7) but it will be appreciated that the form of the actuator (152) should not be construed as limiting or exclusive of any other form of manually operable actuator (152). In the case of the actuator shown in FIG. 7, the actuator is connected at each end thereof to respective levers (154). Each lever (154) has a first end (154*a*) that connects to the actuator (152) and a second end (154*b*) that connects to a spring plunger (156), as shown in greater detail in FIG. 8. At the midpoint of the lever (154), a pin (160) connects the lever (154) to a fixed flange (162) mounted to the head end (16*a*) of the frame (12) that facilitates rotation of the lever (154) around an axis defined by the midpoint of the lever (154). The spring plunger (156) comprises a spring loaded pin (not shown) that is biased to project from the bottom of the spring plunger (156). When in the biased configuration, the spring loaded pin engages a hole, or notch, in a striker plate (162) mounted to the base (14) to prevent lateral movement of the spring plunger (154) relative to the striker plate (162). Consequently, the frame is locked in the first, upright configuration. As an added measure to resist unintended operation of the actuator (152), an index plunger (164) is mounted to the base (14) laterally relative to the lever (154). A hole, or notch, is provided through the lever such that when the lever is oriented in a first configuration, i.e., when the frame (12) is locked in the first, upright configuration, the indexing plunger (164) engages the hole, or notch, to prevent rotation of the lever (154) around the pin (160). By disengaging the indexing plunger (164) from the hole, or notch, in the lever (154), a user may operate the actuator (154) by hand or depressing the horizontal bar using his/her foot. Such operation causes the spring loaded pin of the indexing plunger (156) to disengage from the hole, or notch in the striker plate (162). The frame (12) may then be moved from the first, upright configuration to the second, horizontal configuration.

When the frame (12) is moved from the second, horizontal configuration to the first, upright configuration, the spring loaded pin of the spring plunger (154) again engages the hole, or notch, in the striker plate (162).

The weight of the frame (12) and a mattress attached thereto, provide resistance against the frame (12) moving from the second, horizontal configuration. To move the frame (12) from the second, horizontal configuration to the first, upright configuration, a user is required to lift the frame (12) upwards from the foot end (16*b*) thereof so that the frame (12) pivots at the head end (16*a*) of the frame relative to the base (14). The gas struts aid a user to lift the weight of the frame (12) and attached mattress.

Part of the frame (12) mounts one or more attachments (44, 48, 62) for use in exercise activities.

In some embodiments, a diagonal support member (42) is positioned between at least one of the plurality of legs (22) and a side (18*a*, 18*b*) of the frame (12). In the embodiment illustrated in FIG. 1, each of the legs (22) positioned at the corners between the sides (18*a*, 18*b*) and head end (16*a*) of the frame (12) is provided with a diagonal support member (42).

Figure 9:
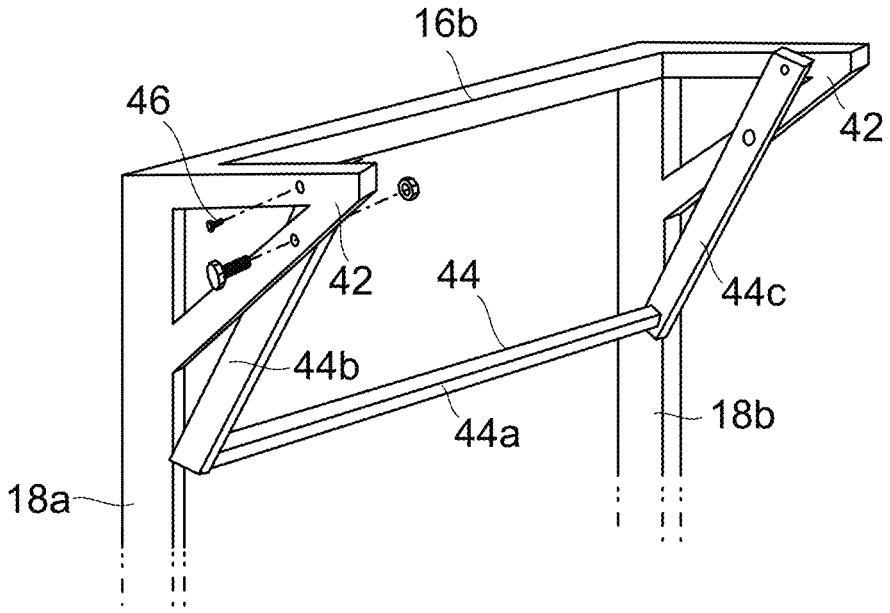
FIG. 9 shows a first view of a pull up bar used in the present invention.
Figure 10:
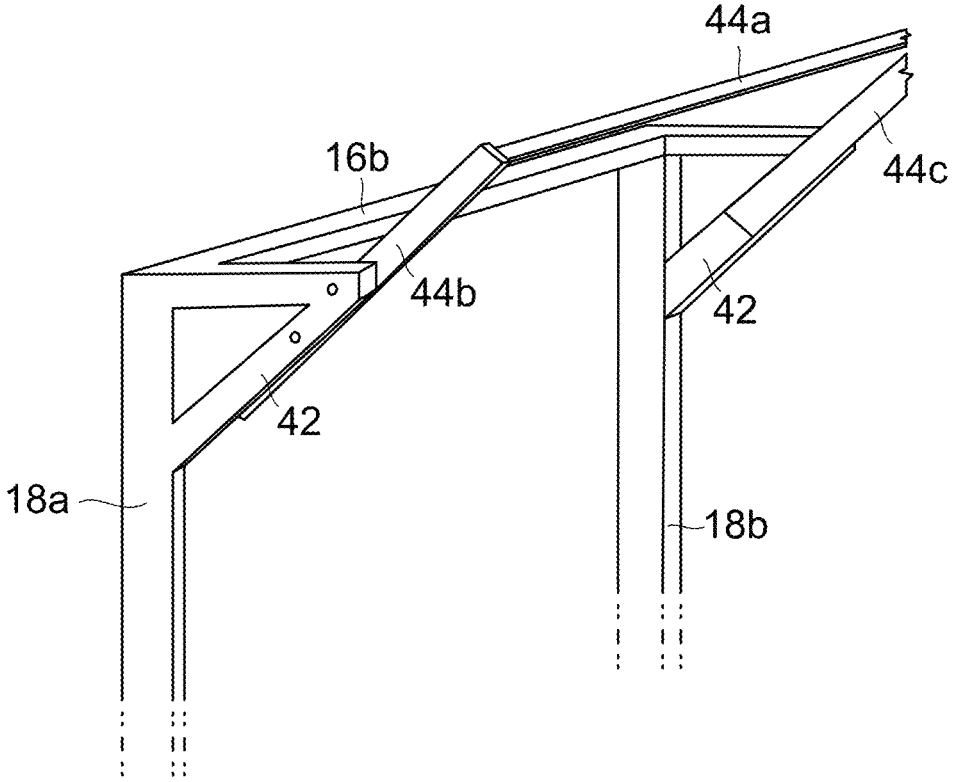
FIG. 10 shows a second view of the pull up bar.

In some embodiments, a pull up bar (44), as shown in FIGS. 9 and 10, is attached to each of the diagonal support members (42) at the head end (16*a*) of the frame (12). The pull up bar (44) is movable between a first position, as shown in FIG. 9, in which the pull up bar (44) is stowed to a second position, as shown in FIG. 10, in which the pull up bar (44) is extended for use in performing pull ups. In the stowed configuration, the pull up bar (44) may be folded substantially flat against the underside of the frame (12). In the extended configuration, the pull up bar (44) may extend out and away from the underside of the frame (12).

Movement of the pull up bar (44) from the first position to the second position is facilitated by way of a pivot connection between the pull up bar (44) and the two diagonal support members (42) at the head end (16*a*) of the frame. In the embodiment illustrated in the figures, the pull up bar (44) comprises a horizontal member (44*a*) and two vertical members (44*b*, 44*c*). The vertical members (44*b*, 44*c*) are pre-drilled distal from the horizontal member to receive a pin (46) therethrough. The diagonal support members (42) at the head end (16*a*) of the frame (12) are also pre-drilled to receive the pins (46) therethrough. In some embodiments, bushings may be inserted into each of the pre-drilled holes in the vertical members (44*b*, 44*c*) of the pull up bar (44) and diagonal support members (42). The bushings may be metal flange bushings impregnated with PTFE to provide a low-friction surface. In some embodiments, nylon washers may be arranged between the vertical members (44*b*, 44*c*) of the pull up bar (44) and the diagonal support members (42).

In some embodiments, each diagonal support member (42) may be pre-drilled with a plurality of holes to receive a pin (46). This facilitates securing of the pull up bar (44) in a plurality of angular orientations relative to the frame (12). The pin (46) is inserted through the pre-drilled hole in the vertical member (44*b*, 44*c*) of the pull up bar (44) and into one of the pre-drilled holes in the diagonal support member (42) such that the pull up bar (44) can be used for different types of pull ups and by users of differing heights.

Figure 11:
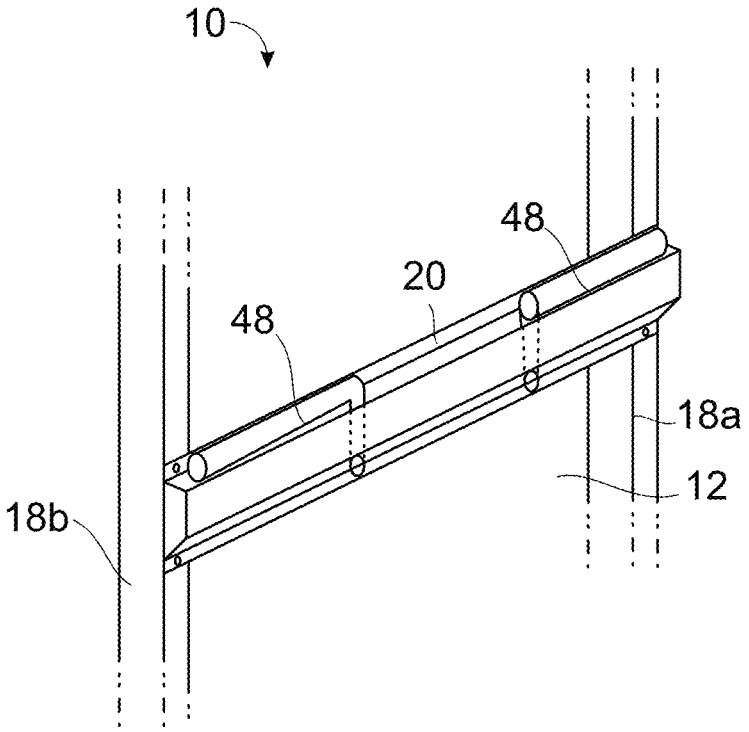
FIG. 11 shows a first view of a pair of dip bars used in the present invention.
Figure 12:
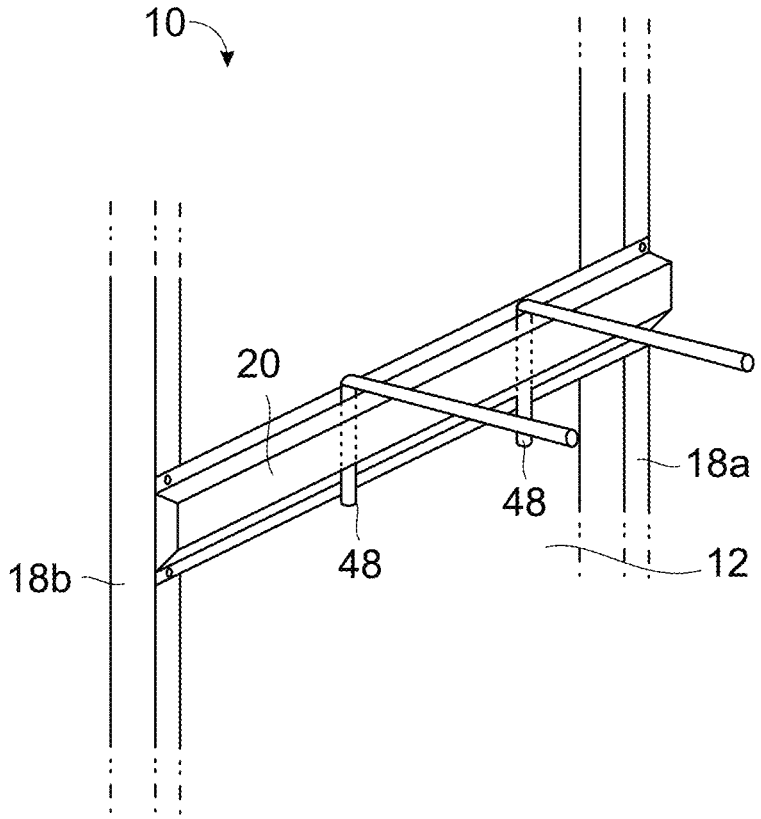
FIG. 12 shows a second view of the pair of dip bars.

As illustrated in FIGS. 11 and 12, a pair of dip bars (48), in some embodiments, is attached to at least one of the slats or braces (20). The dip bars (48) are rotatably attached to the slat(s) or brace(s) (20) such that in a first position, as shown in FIG. 9, the dip bars (48) are stowed and folded substantially flat against the underside of the frame (12) and in a second position, as shown in FIG. 10, the dip bars (48) extend out and away from the underside of the frame (12). Alternatively, the dip bars (48) may simply clip, or otherwise attach to the frame (12) in either of the first or second position.

Each dip bar (48) comprises a L-shaped steel tube, channel, section or the like and is attached to the slat(s) or brace(s) (20). In the illustrated embodiment, the slat or brace (20) comprises a channel section. Holes are pre-drilled through the channel section of the slat or brace (20) for receiving the tubular structure of the dip bars (48).

Figure 13:
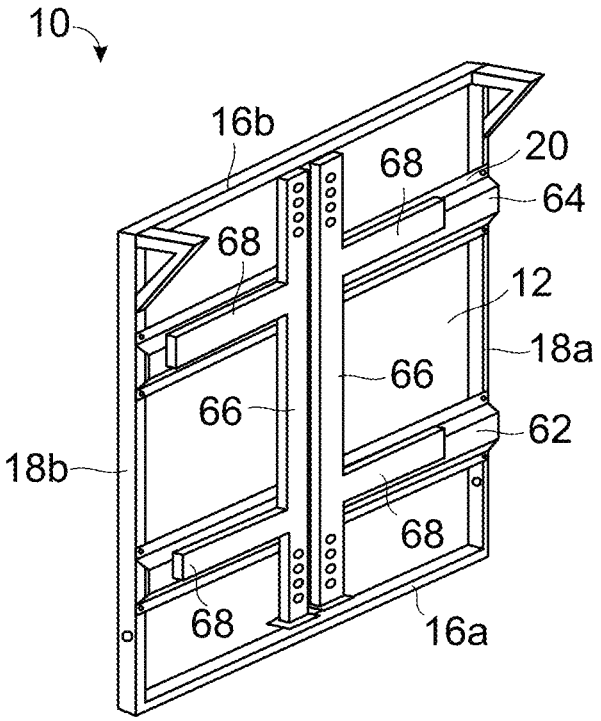
FIG. 13 shows a first view of an exercise rack used in the present invention.
Figure 14:
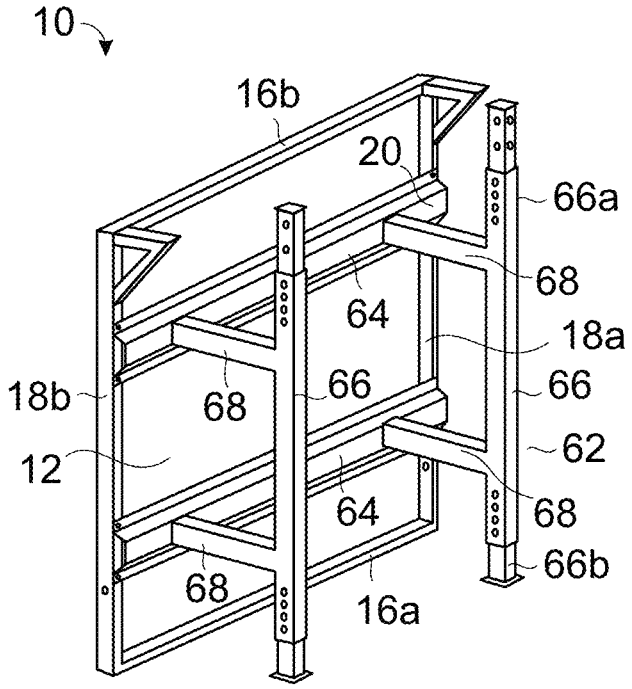
FIG. 14 shows a second view of the exercise rack.

FIGS. 13 and 14 show a rack attachment (62). In a first position, as shown in FIG. 11, the rack attachment (62) is stowed and is flush to and positioned within the frame (12). In a second position, as shown in FIG. 12, the rack attachment (62) extends substantially perpendicularly from the frame (12). The rack attachment (62) comprises a pair of horizontal support members (64) that are each attached, i.e., bolted, to respective slats or braces (20) of the frame (12).

A pair of legs (66) are pivotably attached to both horizontal support members (64) by way of a pair of pivot arms (68). When the legs (66) are moved from the first position to the second position, they are configured to pivot outwardly before being locked in place by a locking pin. The legs (66) are pre-drilled proximate to the horizontal support members (64). The horizontal support members (64) are also pre-drilled. The locking pin engages the pre-drilled holes in both a leg (66) and a horizontal support member (64) to lock the leg (66) relative to the horizontal support member (64) in either the first position or second position.

Each of the legs (66) comprises a first, outer, portion (66*a*) and second, inner, portion (66*b*) configured such that the second, inner, portion (66*b*) can be extended from and retracted into the first, outer, portion (66*a*). When the legs (66) are in the first position, i.e., flush with and positioned within the frame (12), the second, inner, portions (66*b*) of the legs (66) are substantially retracted into the first, outer, portion (66*a*) of the legs (66) to keep the length of the legs (66) short enough to fit within the bounds of the frame (12). When the legs (66) are in the second position, i.e., extending away from the frame (12), the second, inner, portion (66*b*) is extended from the first, outer, portion (66*a*) of the legs to enable the legs (66) to engage the floor upon which the exercise apparatus (10) is situated.

Figure 15:
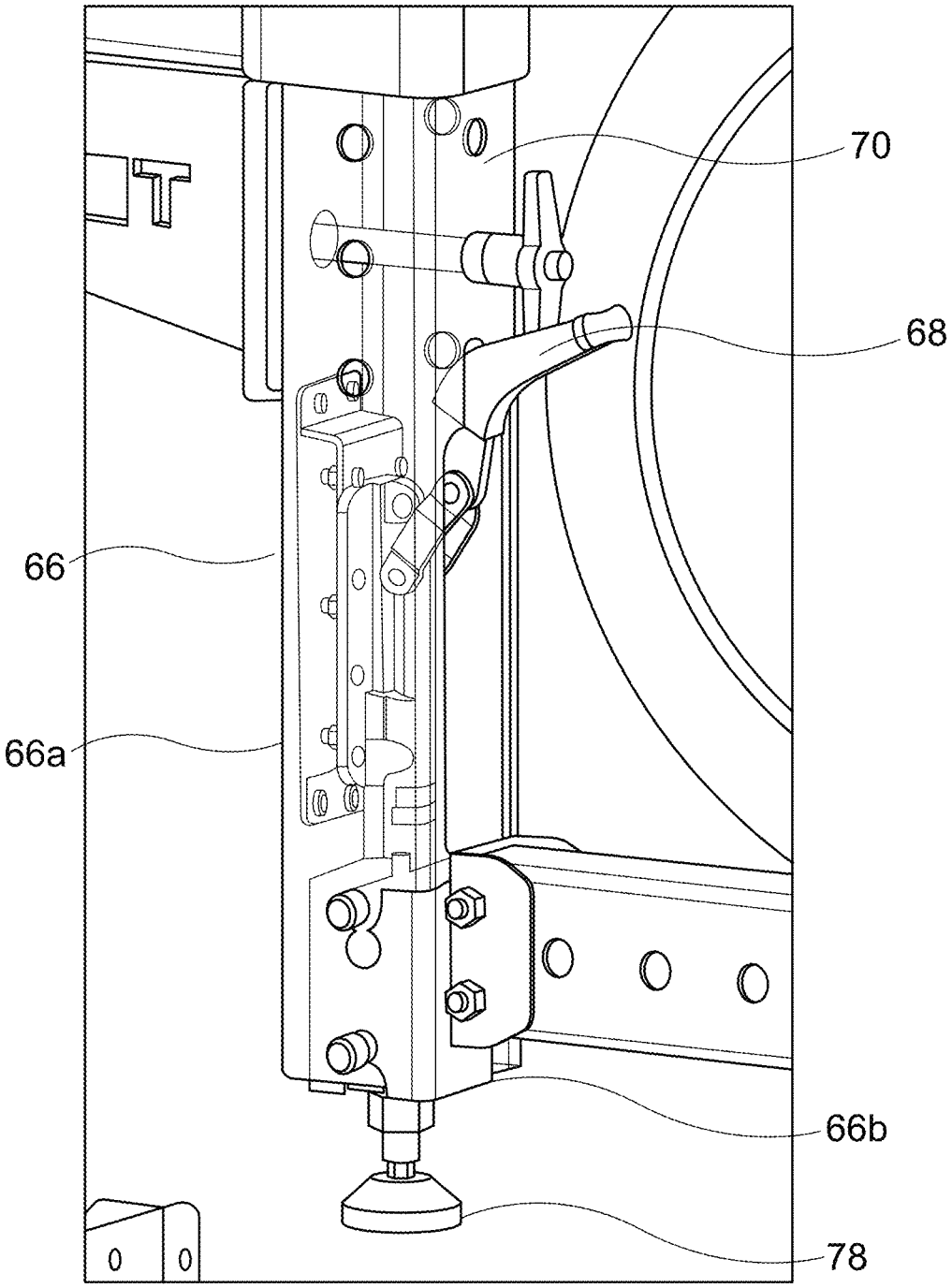
FIG. 15 shows a first detailed view of a telescopic leg of the exercise rack of FIGS. 13 and 14.
Figure 16:
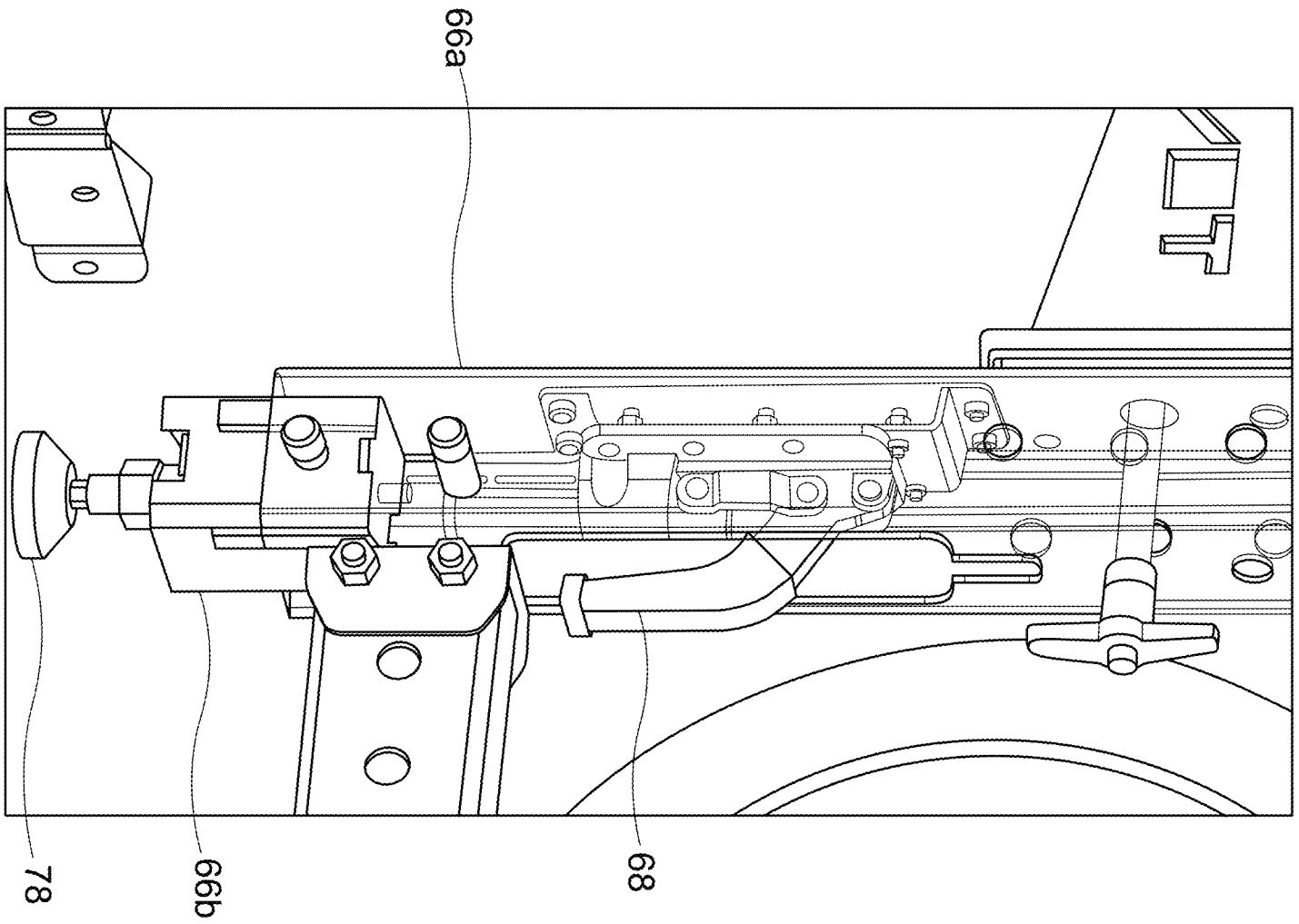
FIG. 16 shows a second detailed view of the telescopic leg of FIG. 15.
Figure 17:
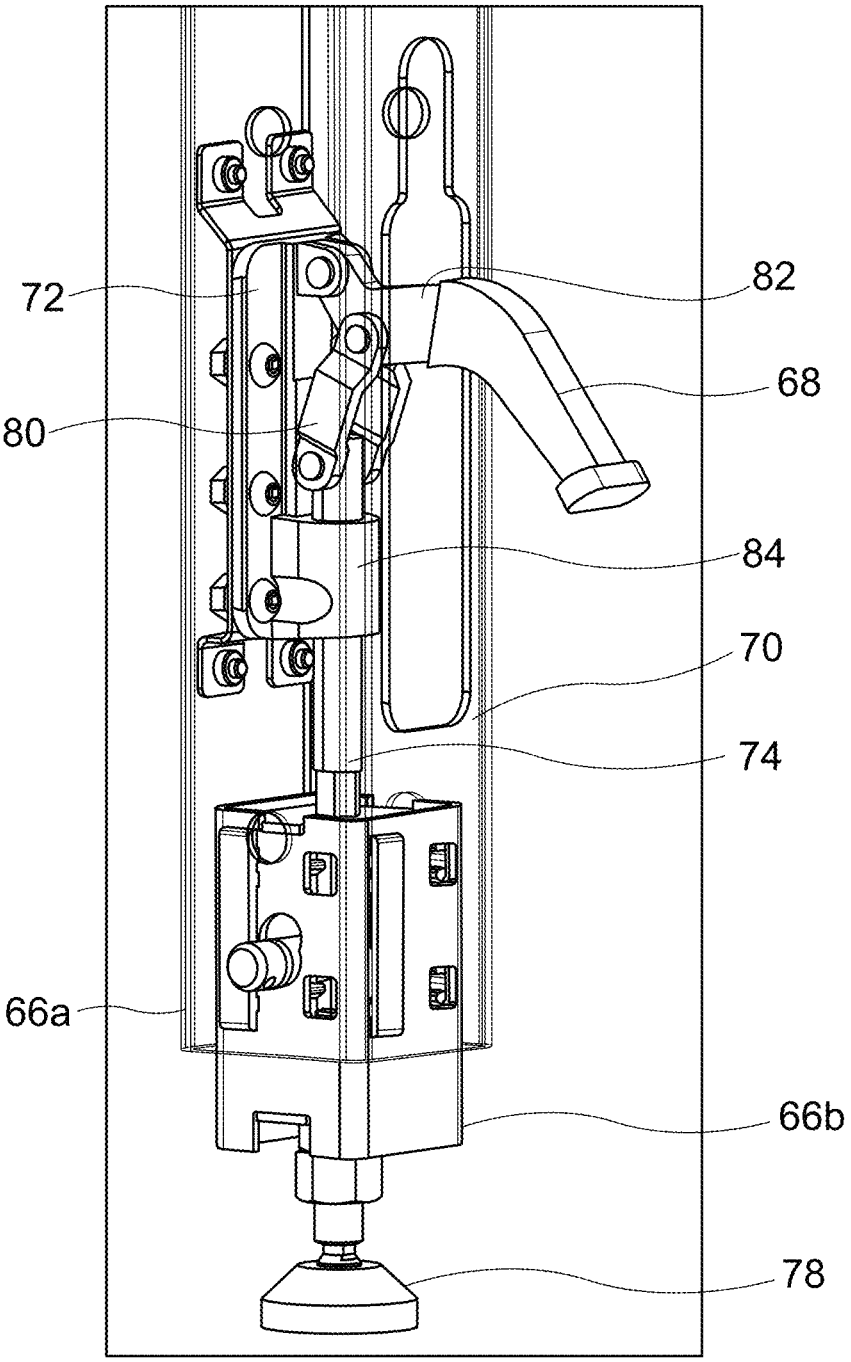
FIG. 17 shows a third detailed view of the telescopic leg of FIGS. 15 and 16.

As shown in FIGS. 15 to 17, a handle (68) extends through a sidewall (70) of the first, outer portion (66*a*) and is operable to be moved between a first configuration (as shown in FIG. 15) in which the second, inner portion (66*b*) of a leg (66) is substantially retracted into the first, outer portion (66*a*) of the leg (66) to a second configuration (as shown in FIG. 16) in which the second, inner portion (66*b*) of the leg is extended from the first, outer portion (66*a*) of the leg (66). The first, outer portion (66*a*) of each leg (66) mounts a handle mounting bracket (72) (as shown in FIG. 17). The handle (68) is mounted to both the handle mounting bracket (72) and a substantially vertical bar (74). Operation of the handle (68) causes it to rotate relative to the handle mounting bracket (72) and urge the substantially vertical bar (74) upwards when the handle (68) is in the first configuration and downwards when the handle (68) is in the second configuration. This is facilitated by a hinged link (80) that provides a double hinge between a lever (82) of the handle (68) and the substantially vertical bar (74). When the handle (68) is in the first configuration, the hinged link (80) forms an obtuse angle between the lever (82) of the handle (68) and the substantially vertical bar (74) to enable an end of the substantially vertical bar (74) distal to the handle (68) to translate upwardly towards the lever (82) of the handle (68). When the handle (68) is in the second configuration, the hinged link (80) is oriented substantially in line with the substantially vertical bar (74) to enable the end of the substantially vertical bar (74) distal to the handle (68) to translate downwardly away from the lever (82) of the handle (68).

The substantially vertical bar (74) also mounts the second, inner portion (66*b*) of the leg such that operation of the handle (68) by the user causes the second, inner portion (66*b*) of the leg to retract into and extend from the first, outer portion (66*a*) of the leg (66) depending on whether the handle (68) is in the first configuration or second configuration respectively. The position of the second, inner portion (66*b*) of the leg (66) may be locked in position by way of a locking pin (76) that inserts into aligned holes between the first, outer portion (66*a*) and second, inner portion (66*b*) of the leg (66). When in the second configuration, the handle (68) drives a ground engaging member (78) into a floor surface.

The ground engaging member (78) may be a foot, wheel, or caster, for example. In some embodiments, the ground engaging member (78) may retract fully into the outer portion (66*a*) of the leg (66) when the handle (68) is in the first configuration. In other embodiments, the ground engaging member (78) may still protrude from the leg (66) when the handle (68) is in the first configuration. When the handle (68) is in the second configuration, the ground engaging member provides secure contact with the floor surface and supports the rack attachment (62) at a point away from the pivot point between the frame (12) and base (14). This allows for weight plates of significant weight to be added to the rack attachment (62) for the user to perform resistance exercise routines.

The second, inner portion (66*b*) of the leg (66) is sized to fit closely within the first, outer portion (66*a*) of the leg (66). Such arrangement limits lateral movement of the second, inner portion (66*b*) of the leg (66) relative to the first, outer portion (66*a*) of the leg (66). The inner portion (66*b*) may, in some embodiments, comprise a guide slot on at least one outer face thereof and the outer portion (66*a*) may comprise a guide projection on at least inner face thereof such that the guide slot and guide projection cooperate to further limit lateral movement of the inner portion (66*b*) of the leg (66) relative to the outer portion (66*a*) of the leg (66). Alternatively, as shown in FIG. 17, a guide (84) may protrude from the handle mounting bracket (72). The guide (84) may comprise a hole that is axially aligned with the substantially vertical bar (74) such that the substantially vertical bar (74) passes through the guide (84) and is able to translate axially, as described above but is restrained laterally.

While not shown in the figures, the rack attachment (62) may further comprise first and second clamps or locking means for securing a barbell, or other elongated weight bar, to the rack attachment when in the first position, i.e., stowed within the frame. For example, each leg (66) of the rack attachment may comprise a receiving formation for receiving an end of a barbell and the clamp, or locking means, may secure the position of an end of the barbell relative to the rack attachment (62) as the bed (10) is moved between the first, upright, configuration and second, horizontal configuration, and vice versa. Similarly, the frame (12) may comprise first and second clamps or locking means as described above.

Each of the pull up bar (44), dip bars (48) and rack (62) are stowed within the frame (12) when the frame (12) is in the second, horizontal, configuration and can be independently extended, as described above, relative to the frame (12) for use in exercise when the frame (12) is in the first, upright, configuration.

The preceding description has been presented with reference to the presently preferred embodiments of the invention shown in the drawings. The person skilled in the art to which this invention pertains will appreciate that alteration and changes in the described processes and structures can be practised without departing from the spirit, principles and scope of this invention.

Accordingly, the present invention provides exercise apparatus configured to be moved between a first, upright, configuration and a second, horizontal, configuration. Although this invention has been described in certain specific embodiments, many additional modifications and variations would be apparent to the person skilled in the art. It is therefore to be understood that this invention may be practised otherwise than as described. Thus, the present embodiments of the invention should be considered in all respects as illustrative and not restrictive, the scope of the invention to be determined by the claims supported by this application and their equivalents rather than the foregoing description.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An exercise apparatus comprising:

a frame having a plurality of support legs extending perpendicularly therefrom;

a base having a stand for supporting the frame; and one or more attachments configured to rotate from a first position in which the one or more attachments is stowed and positioned within the frame and a second position in which the one or more attachments away from the frame, wherein the one or more attachments comprise a rack having first and second legs each configured to rotate from the first position in which each of the first and second legs is stowed and positioned within the frame and the second position in which each of the legs extends substantially perpendicularly from the frame, wherein each of the first and second legs comprise an outer portion and an inner portion, configured such that the inner portion can be extended from and retracted into the outer portion, and in the first position, the inner portion of the legs are substantially retracted into the outer portion, wherein, the frame is configured in a pivotable relationship with the base such that the frame is permitted to pivot relative to the base from a first, upright configuration to a second, horizontal configuration, wherein the frame is selectively restrained in the first, upright configuration by a locking mechanism engaging the base, the locking mechanism comprising an actuator and at least one retaining pin biased in a locked position to restrain pivoting of the frame relative to the base, and wherein the locking mechanism is configured to be released by operation of the actuator.

2. The exercise apparatus of claim 1, wherein the stand comprises at least one aperture for receiving the at least one retaining pin when the frame is in the first, upright configuration relative to the base and the retaining pin is configured to move from an engaged position whereby the at least one retaining pin is inserted into the at least one aperture upwardly into a disengaged position when the actuated is operated and downwardly to re-engage with the aperture when the actuator is released.

3. The exercise apparatus of claim 1, wherein the actuator comprises a handle and a wire extending therefrom terminating at the at least one locking pin.

4. The exercise apparatus of claim 3, wherein the at least one locking pin comprises two locking pins and the at least one aperture comprises two apertures.

5. The exercise apparatus of claim 4, wherein the wire extends from the handle to each of the locking pins and operation of the actuator is configured to disengage each locking pin from a respective aperture.

6. The exercise apparatus of claim 2, wherein a sleeve extends from each aperture in the stand and is configured to receive a respective locking pin.

7. The exercise apparatus of claim 2, wherein each locking pin comprises a spring plunger that is configured to engage a striker plate when the frame is in the first, upright configuration.

8. The exercise apparatus of claim 4, wherein each locking pin is biased in the engaged position by a respective spring and operation of the actuator temporarily overcomes the biasing force imparted on each locking pin by the respective spring.

9. The exercise apparatus of claim 1, wherein the one or more attachments comprise a pull up bar attached to the frame and configured to rotate from a first position in which the pull up bar is stowed and positioned within, and angled towards, the frame and a second position in which the pull up bar extends substantially perpendicularly from the frame.

10. The exercise apparatus of claim 8, wherein the pull up bar comprises a locking mechanism configured to lock the angular orientation of the pull up bar relative to the frame in one of a plurality of different, pre-determined angular orientations.

11. The exercise apparatus of claim 1, wherein the one or more attachments comprise a pair of dip bars attached to the frame and configured to rotate from a first position in which each of the pair of dip bars is stowed and positioned within the frame and a second position in which each of the pair of dip bars extends substantially perpendicularly from the frame.

12. The exercise apparatus of claim 11, wherein the pair of dip bars comprises a locking mechanism configured to lock the pair of dip bars in either the first position or the second position.

13. The exercise apparatus of claim 1, wherein each leg of the rack comprises a locking mechanism configured to lock the leg in either the first position or the second position.

14. The exercise apparatus of claim 1, wherein each leg of the rack is extendible such that when the leg is in the first position, the leg has a first length and when in the second configuration, the leg has a second length longer than the first length.

15. The exercise apparatus of claim 14, wherein each leg of the rack comprises telescopic extension means.

16. The exercise apparatus of claim 15, wherein each leg comprises the outer portion and the inner portion, and an actuator configured to move the inner portion from a first position in which it is substantially retracted into the outer portion to a second position in which it is substantially extended from the outer portion.

17. The exercise apparatus of claim 16, wherein the actuator comprises a handle that is mounted to an inner wall of the outer portion of the leg and extends through a cut-out in an opposing wall of the outer portion of the leg.

18. The exercise apparatus of claim 16, wherein operation of the actuator into the second position urges a ground engaging member of the inner portion of the leg into contact with a floor surface.

19. A bed comprising:

a frame having an upper side for supporting a mattress and an underside, and a plurality of support legs extending perpendicularly therefrom;

a base having a stand for supporting the frame; and one or more attachments attached to the underside of the frame configured to rotate from a first position in which the one or more attachments is stowed and positioned within the frame and a second position in which the one or more attachments away from the frame, wherein the one or more attachments comprise a rack having first and second legs each configured to rotate from the first position in which each of the first and second legs is stowed and positioned within the frame and the second position in which each of the legs extends substantially perpendicularly from the frame, wherein each of the first and second legs comprise an outer portion and an inner portion, configured such that the inner portion can be extended from and retracted into the outer portion, and in the first position, the inner portion of the legs are substantially retracted into the outer portion, wherein, the frame is configured in a pivotable relationship with the base such that the frame is permitted to pivot relative to the base from a first, upright configuration to a second, horizontal configuration, wherein the frame is selectively restrained in the first, upright configuration by a locking mechanism engaging the base, the locking mechanism comprising an actuator and at least one retaining pin biased in a locked position to restrain pivoting of the frame relative to the base, and wherein the locking mechanism is configured to be released by operation of the actuator.

20. An exercise apparatus comprising:

a frame having a plurality of support legs extending perpendicularly therefrom;

a base having a stand for supporting the frame; and one or more attachments configured to rotate from a first position in which the one or more attachments is stowed and positioned within the frame and a second position in which the one or more attachments away from the frame, wherein the one or more attachments comprise a rack having first and second legs each configured to rotate from the first position in which each of the first and second legs is stowed and positioned within the frame and the second position in which each of the legs extends substantially perpendicularly from the frame, wherein each leg of the rack is extendible such that when the leg is in the first position, the leg has a first length and when in the second configuration, the leg has a second length longer than the first length, wherein each leg of the rack comprises telescopic extension means, wherein, the frame is configured in a pivotable relationship with the base such that the frame is permitted to pivot relative to the base from a first, upright configuration to a second, horizontal configuration, wherein the frame is selectively restrained in the first, upright configuration by a locking mechanism engaging the base, the locking mechanism comprising an actuator and at least one retaining pin biased in a locked position to restrain pivoting of the frame relative to the base, and wherein the locking mechanism is configured to be released by operation of the actuator.

* * * * *